US005759054A

United States Patent [19]

Spadafore

[11] Patent Number: 5,759,054

[45] Date of Patent: Jun. 2, 1998

[54] LOCKING, WIRE-IN FLUORESCENT LIGHT ADAPTER

[75] Inventor: Michael A. Spadafore, Newbury, Mass.

[73] Assignee: Pacific Scientific Company, Newport Beach, Calif.

[21] Appl. No.: 725,914

[22] Filed: Oct. 4, 1996

Related U.S. Application Data

[60] Provisional application No. 60/005,003, Oct. 6, 1995.

[51] Int. Cl.[6] ..... H01R 33/02; H01R 33/08

[52] U.S. Cl. ..... 439/236; 439/903

[58] Field of Search ..... 439/236, 529, 439/542, 576, 903

[56] References Cited

U.S. PATENT DOCUMENTS 5,044,974 9/1991 Pelton et al. ..... 439/236

*Primary Examiner*—Gary F. Paumen

*Attorney, Agent, or Firm*—Knobbe, Martens, Olson & Bear, LLP

[57] ABSTRACT

An improved fluorescent light adapter for incandescent light fixtures. The adapter may be directly wired in to the Edison light fixture, and also includes locking structure to prevent theft. Specifically, the adapter includes a lower housing with a plurality of channels, some of which include locking ramps for mating with inwardly directed teeth on the lower sleeve portion of a standard Edison light fixture. To retrofit an existing light, the standard Edison socket is disassembled and the adapter is simply pressed downward locking onto the lower sleeve. The adapter may be provided with an on/off switch or a three-way switch, and includes a variable height neck portion for adapting to a variety of lamp shades and harps.

13 Claims, 5 Drawing Sheets

Fig. 4
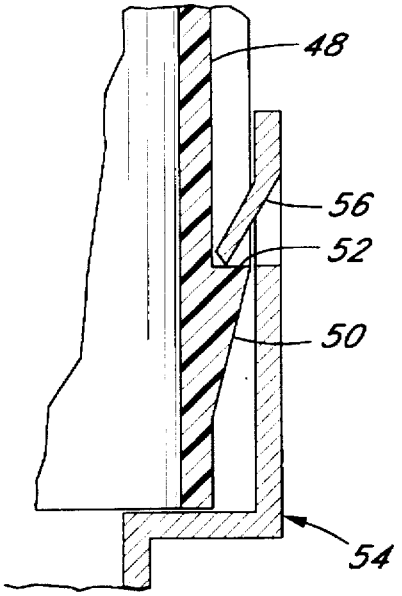
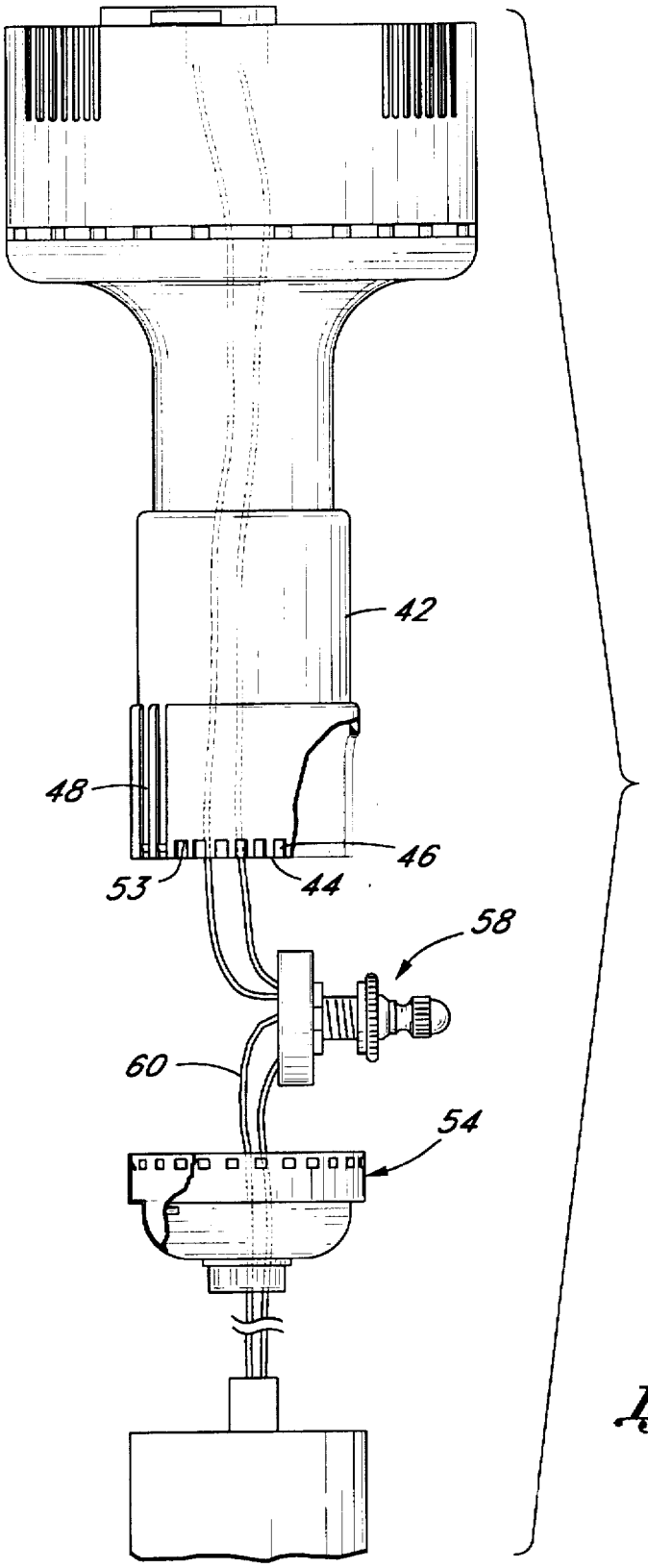
Fig. 3

Fig. 5
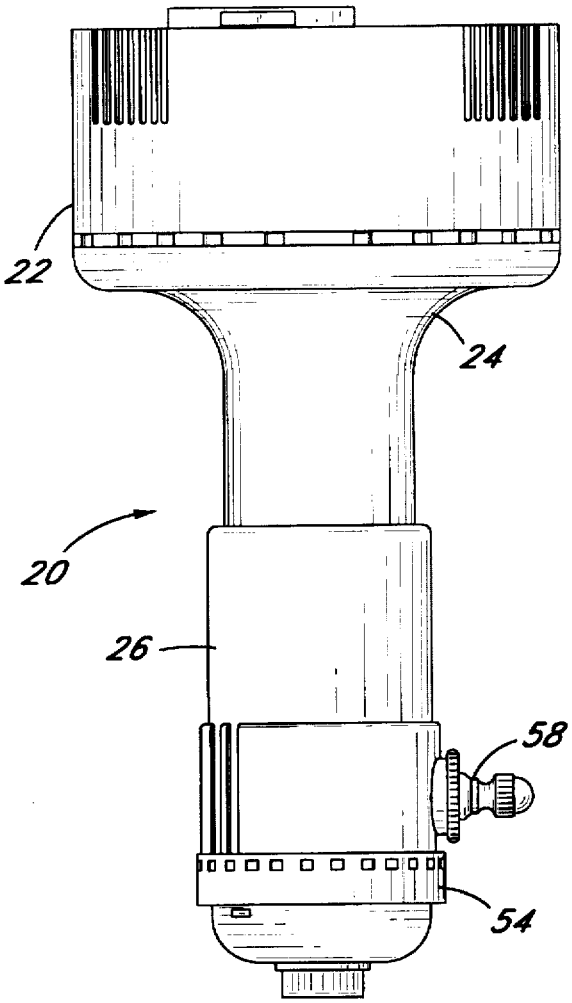
Fig. 6
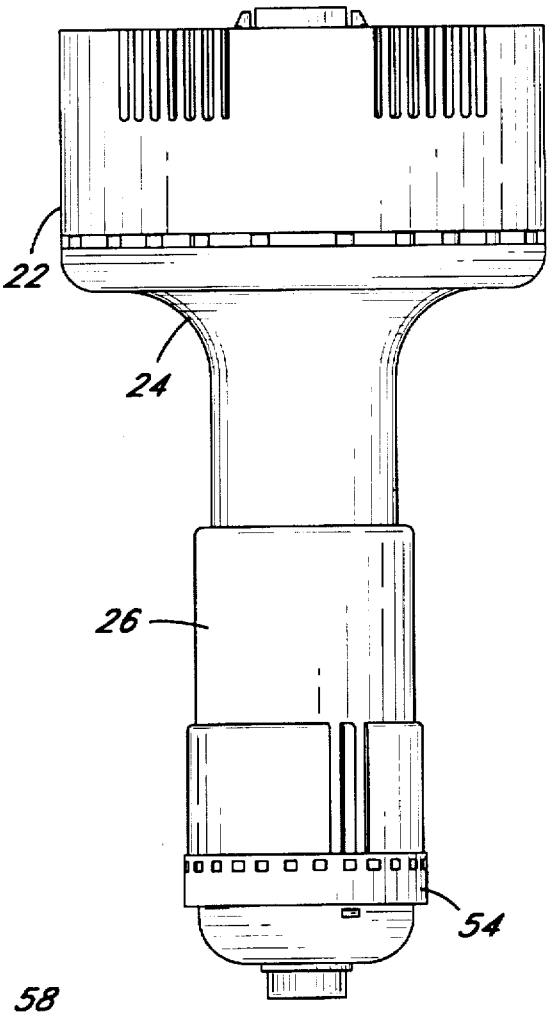
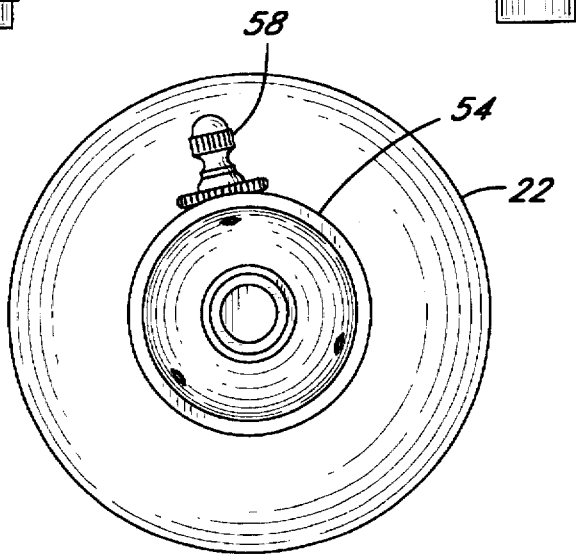
Fig. 7

LOCKING, WIRE-IN FLUORESCENT LIGHT ADAPTER

RELATED APPLICATION

Pursuant to 35 U.S.C. § 119(e), this application claims the priority benefit of Provisional application No. 60/005,033, filed Oct. 6, 1995.

FIELD OF THE INVENTION

The present invention relates to an adapter for converting an incandescent light fixture to one suitable for fluorescent lamps.

BACKGROUND OF THE INVENTION

Currently, there is a shift toward the use of fluorescent lamps in the lighting market in place of incandescent bulbs. Fluorescent lamps are considerably more energy efficient and often more aesthetically pleasing. Not only can the fluorescent lamps be shaped into pleasing configurations, but the quality of the light given off is often preferred.

There are a number of fluorescent lamp adapters on the market which utilize a threaded male portion for screwing into a standard Edison socket, or which are directly wired into the Edison socket after removing the female threaded sleeve. The fluorescent lamp adapter includes circuitry for converting the power supplied into a form suitable for fluorescent lights. More specifically, fluorescent lamps require either a magnetic or electronic ballast circuit. Although these adapters are easy to install, they are also easy to remove, creating a problem for the hotel industry which experiences a significant amount of theft of these products.

Furthermore, the power utilities often offer rebates for wired-in products, that is, light fixtures which are not simply screwed into a standard socket but are instead wired directly to the lamp base. To do this, one simply removes the existing incandescent bulb from the threaded socket, and then disassembles the Edison light fixture. The standard Edison light fixture includes a central sleeve portion enclosing a switch mounted on a lower sleeve portion. The central and lower sleeve portions mate together utilizing small interfering notches or teeth around their periphery. The central portion, made of brass, may be squeezed to remove it from the lower sleeve portion. There is typically a label inscribed on the central portion indicating where to press to squeeze and release the central portion from the lower portion. Thus, even if one has wired-in the new fluorescent adapter, the central sleeve of the Edison adapter can still be removed and the adapter stolen. In recognition of this problem the entire Edison light fixture may be removed and alternative fixtures installed which are "locked in." Again, utility companies have encouraged the use of such locked in adapters through the use of rebates upon their purchase. Although the locked-in adapter is less likely to be stolen, it requires a significant amount of labor to install.

Consequently, there is a need for an improved incandescent to fluorescent light adapter.

SUMMARY OF THE INVENTION

The present invention provides an adapter for converting incandescent light fixtures to receive fluorescent lamps which locks to the existing Edison light fixture and is hard-wired to the fixture circuit. The adapter includes circuitry for converting line voltage to the requisite frequency and magnitude for starting and maintaining energization of a fluorescent lamp, and a fluorescent lamp plug formed on an upper surface for electrically coupling the adapter to a fluorescent lamp. In the preferred embodiment, the adapter comprises an upper housing containing the circuitry and having the plug, and a lower housing firmly attached to the upper housing having structure for locking to the existing Edison light fixture. The lower housing includes a lower tubular portion with a lower peripheral rim and a plurality of axial channels formed in the outer surface extending upward from the lower rim. The channels are sized and spaced to receive inwardly directed teeth on a lower brass sleeve of the Edison light fixture. Some of the channels have locking structure for retaining the teeth and locking the adapter and sleeve together.

One aspect of the invention is a method of easily retrofitting a fluorescent lamp adapter to an existing Edison light fixture. The fixture typically includes an upper cylindrical brass portion attached to a lower sleeve. First, the upper portion is removed leaving the lower sleeve with electric wires extending therefrom. The sleeve includes a plurality of inwardly and downwardly directed teeth circumferentially spaced around the circular sleeve. The adapter is electrically connected to the fixture and then a lower tubular portion of the adapter is inserted into the sleeve. The teeth on the sleeve are guided within axial channels formed on the tubular portion and extending upward from a lower rim of the adapter. Some of the channels include locking structure which retain the teeth and lock the adapter and sleeve together. The adapter is molded of a material with low flexibility so that the tubular portion cannot easily be compressed to release the teeth from the channels.

BRIEF DESCRIPTION OF THE DRAWING

FIG. 3 is an exploded view of the adapter above a lamp base;

FIG. 4 is a detailed view of a locking apparatus between the adapter and a conventional fixture sleeve;

FIG. 5 is a right side elevational view of the adapter of FIG. 1;

FIG. 6 is a rear elevational view of the adapter of FIG. 1;

FIG. 7 is a bottom plan view of the adapter of FIG. 1;

DETAILED DESCRIPTION OF THE PREFERRED EMBODIMENT

Figure 1:
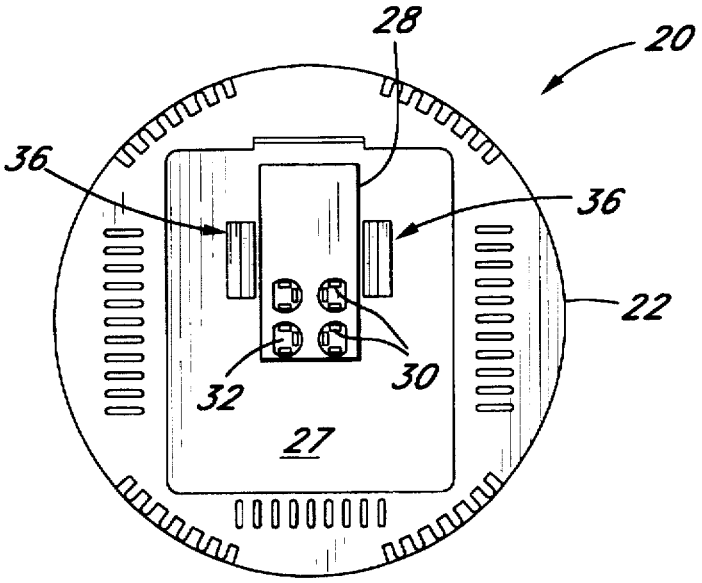
FIG. 1 is a top plan view of one embodiment of a switched fluorescent light adapter of the present invention.

FIGS. 1–7 illustrate one embodiment of a fluorescent light adapter 20 of the present invention comprising a generally cylindrical upper housing 22, a central tapered neck portion 24, and a lower housing 26. The upper housing 22, neck 24, and lower housing 26 are hollow and enclose the light adapter circuitry within. In the preferred embodiment, the upper housing 22 comprises a molded generally cylindrical member having a tubular side wall and a flat upper wall. The neck 24 terminates on an upper end in a generally circular mounting flange 25 which couples to the lower edge of the upper housing 22. A circuit board (not shown) has a generally circular peripheral edge which is sized to rest on a ledge formed by the mounting flange 25. Preferably, the circuit board is sandwiched between the mounting flange 25 and the lower edge of the upper housing 22. The upper housing 22 and mounting flange 24 are coupled together through the use of locking fingers, or other such locking structure well known in the art. The circuit board is positioned at the interface between the upper housing 22 and mounting flange 25 with the circuit components thereon facing upward within the inner space defined by the upper housing. Both the upper and lower housings are advantageously molded from a UV stabilized polycarbonate material approved by Underwriters Laboratory, such as Makralon 6487.

With reference to both FIGS. I and 2, the upper housing 22 includes an upper surface having a generally rectangular recess 27 and an upstanding plug 28. The plug 28 includes a plurality of conductors 30 recessed within apertures 32. Preferably, there are four such apertures 32 containing conductors 30. The plug 28 is sized to extend within a lower portion of a standard fluorescent lamp base (not shown). The plug 28, of course, can be modified to suit a variety of standard fluorescent light bases.

Figure 2:
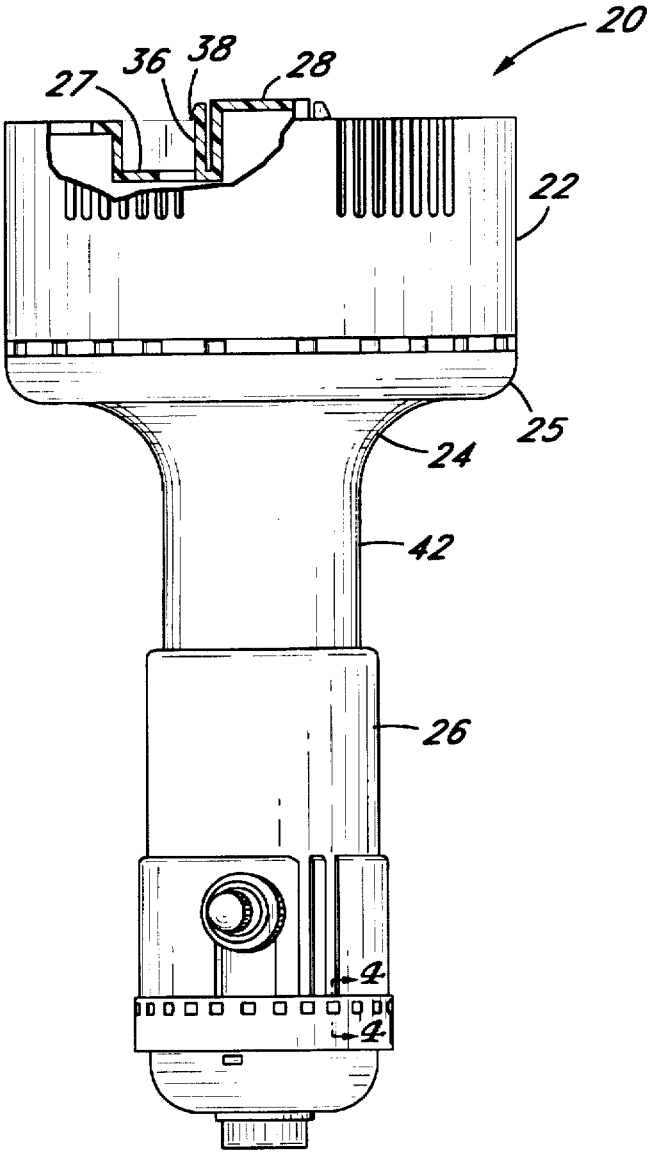
FIG. 2 is a partially cutaway elevational view of the adapter of FIG. 1.

As seen in the cutaway view of FIG. 2, a pair of locking tabs 36 extends upward from the floor of the recess 27 on two sides of the plug 28. Each locking tab 36 comprises a cantilevered plastic element having a detent 38 at an upper end facing outward from the plug 28. The detents 38 on the locking tabs 36 are sized and shaped mate with corresponding structure on the fluorescent lamp base. More particularly, the locking tabs 36 may bend inward due to their cantilevered construction, allowing the detents 38 to cam past a locking structure provided on the lamp base.

Commonly, the fluorescent lamp base is simply pressed down over the plug 28 to couple the detents 38 and associated structure on the fluorescent lamp, and the lamps are provided with release levers or buttons to enable the replacement of the fluorescent lamp when it wears out. The upper housing 22 is provided with a plurality of slit-like vents 40 on both the upper surface and the circular outer periphery. These vents 40 allow heat dissipation from the interior of the housing 22 generated by the inner adapter circuitry. In this regard, the adapter 20 includes electronic ballast circuitry for converting line voltage to the requisite frequency and magnitude for starting and maintaining energization of the fluorescent lamp attached to the plug 28.

Moreover, the present adapter 20 preferably includes a PC board having the particular circuit components mounted thereon positioned at the interface between the upper housing 22 and mounting flange 25 with the components extending upward therefrom. In this manner, the vents formed in the upper housing 22 efficiently dissipate heat from the interior of the adapter 20. The PC board preferably includes a number of rigid connector pins extending upward and having a height sufficient for engagement with a lower end of the plug 28. The connector pins from the PC board extend through lower channels in the plug to electrical communication with conductive pins in the plug adapted to receive mating pins of a fluorescent lamp.

From the upper housing 22, the neck 24 gradually tapers down along a curve to a constant diameter portion 42 which receives thereon the lower housing 28. More particularly, these cylindrical pieces are preferably adhered together with glue or other such expedient.

Referring to FIGS. 3 and 4, the lower housing 26 extends downward to a bottom rim 44 around the exterior of which a plurality of axially extending short channels 46 are provided. On diametrically opposed sides of the rim 44, two pairs of taller grooves 48 are provided. In each groove 48, a ramp 50 having an upper stop 52 is formed. The ramp 50 tapers outward in an upward direction leading to the stop 52. Each ramp 50 is located within its associated groove 48 such that the stop 52 is positioned axially below the top end of the short channels 46. The ramp 50 is adapted to mate with a lower sleeve portion 54 of a standard Edison light fixture. In this regard, the lower sleeve portion 54 of the standard Edison fixture includes a plurality of inwardly directed teeth 56 regularly spaced around the periphery. The teeth 56 are conventionally punched out of the brass material of the sleeve, and thus comprise cantilevered tangs angled downward and inward. The channels 46 and grooves 48 are spaced in a circumferential pattern around the lower housing 26 corresponding to the pattern of the teeth 56. Furthermore, the channels 46 and grooves 48 have diameters sized the same as, or slightly larger than, the diameter of a circle at the inwardmost ends of the teeth 56.

As the lower housing 26 is pressed onto the lower sleeve 54, a majority of the teeth extend a short distance within the channels 46, while four of the teeth extend into the grooves 48. The teeth 56 fit snugly within the channels 46 and grooves 48, or with a slight interference therebetween. The cantilevered teeth 56 within the grooves 48 cam outward over the ramp 50 and then spring back inward above the stop 52. Thus, the brass lower sleeve 54 easily deforms over the ramps 50 and springs backward to lock thereover. The cantilever teeth 56 which are in registry with the short channels 46 contact or come into close proximity with the upper end of the short channels. This limits the travel between the adapter 20 and the sleeve 54 toward each other. The combination of the stops 52 and upper ends of the channels 46 thus retain the sleeve 54 in a fixed axial relationship with respect to the adapter 20 so that there is little or no looseness therebetween. The adapter 20 is preferably made of a material such as Makralon with relatively little resiliency so that once the teeth 56 extend past the stop 52, the adapter 20 is effectively locked onto the sleeve 54. Of course, with some prying using the grooves 58, one could disassembly the adapter 20 from the sleeve, although such an operation might damage one or both of the elements.

Of course, prior to locking the lower sleeve 54 onto the lower housing 26, the central sleeve of the standard Edison socket is removed from the lower sleeve and the wires leading through the lamp base disconnected. The wires are then attached to wires extending down through the lower housing 28, or to a switch 58 provided therein. The switch 58 may be a standard on/off switch or may be a three-way light switch to provide for some dimming of the fluorescent lamp.

Figure 8:
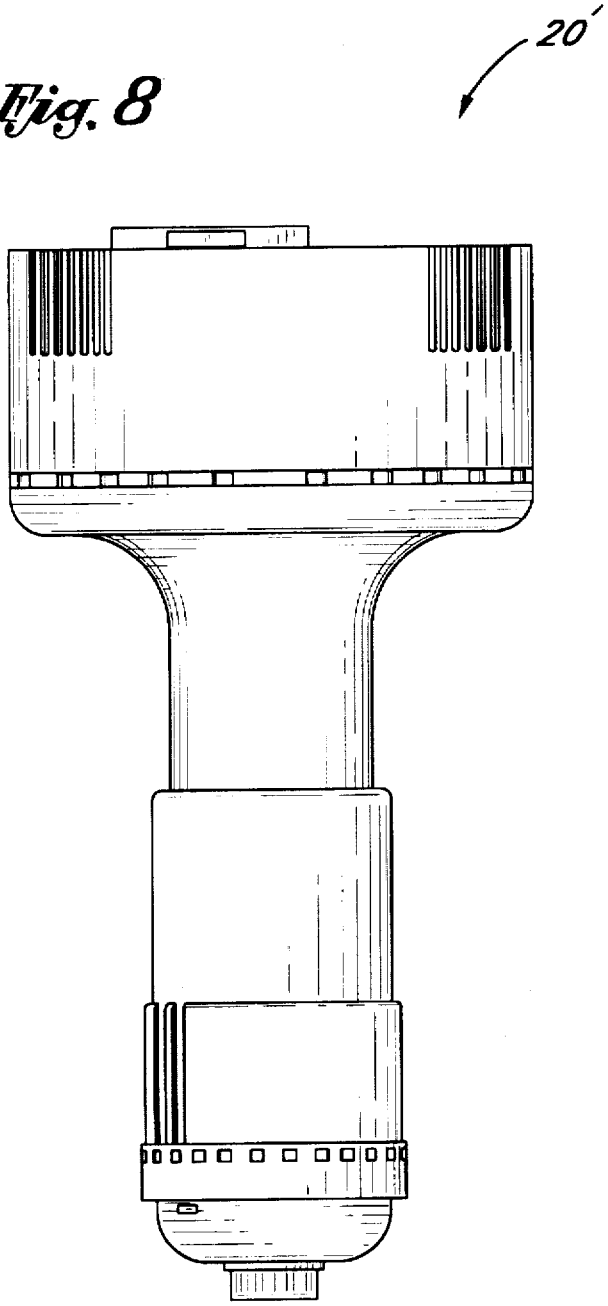
FIG. 8 is a side elevational view of a second embodiment of a fluorescent light adapter of the present invention being provided without a switch.

FIGS. 1–7 illustrate one version of the adapter 20 having a switch 58, while FIG. 8 illustrates an identical version 20' without the switch 58. In this version, the wires extending downward from the circuitry within the upper housing 22 are simply spliced onto the wires extending upward from the lamp base.

Figure 9:
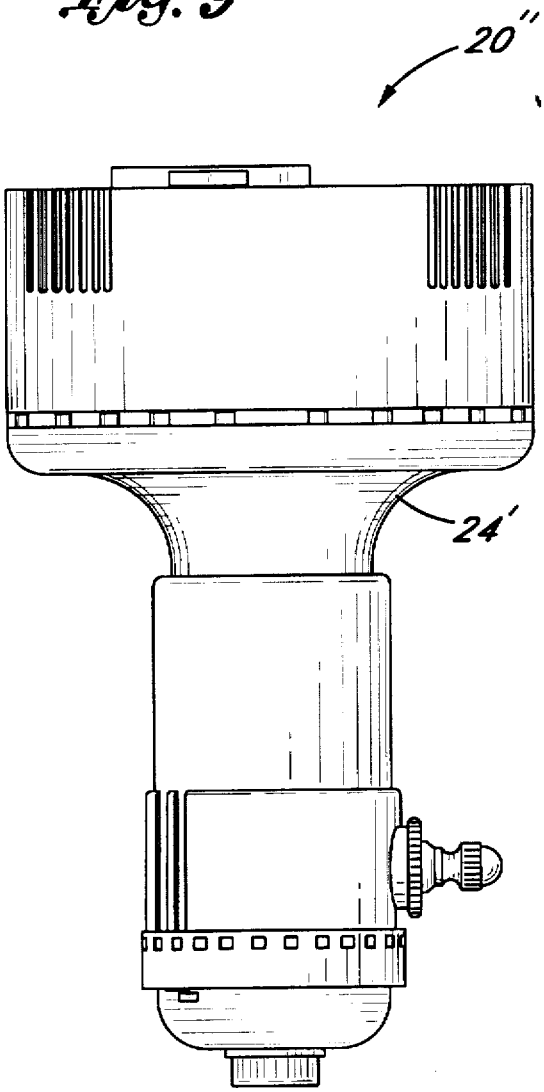
FIG. 9 is a side elevational view of an alternative embodiment of the adapter having a shortened neck portion.

FIG. 9 is an alternative embodiment of a switch adapter 20" with a shortened neck 24'. Of course, other lengths of neck 24 may be provided. The variety provided by the different heights of the adapter 20 allows the adapter to be used with various heights of lamp shades and harps; the harps being the portion which holds the lamp shade above the lamp base.

To retrofit an existing light, the standard Edison socket is disassembled leaving bare wires 60 extending upward through the lower sleeve 54. The wires 60 are then attached to the circuitry within the replacement adapter 20, desirably easily accessible from the rim 44. The adapter 20 is simply pressed downward onto the lower sleeve 54, causing the adapter to be locked to the lower sleeve and lamp base.

Although this invention has been described in terms of certain preferred embodiments, other embodiments that are apparent to those of ordinary skill in the art are also within the scope of this invention. Accordingly, the scope of the invention is intended to be defined by the claims that follow.

What is claimed is:

1. A fluorescent light adapter for incandescent light fixtures which may be directly wired in to a standard Edison light fixture, the light fixture having a lower circular sleeve with inwardly directed teeth spaced circumferentially around an upper peripheral rim, said adapter comprising:

an upper housing containing circuitry for converting line voltage to the requisite frequency and magnitude for starting and maintaining energization of a fluorescent lamp;

a lower cylindrical housing having a lower circular rim sized to fit within the Edison sleeve, said lower housing having a plurality of axially extending channels formed on an outer surface extending upward from said lower circular rim and spaced circumferentially to receive the inwardly directed teeth of the Edison sleeve; and at least two locking ramps located within different ones of said channels for mating with the inwardly directed teeth on the Edison sleeve and locking said adapter to the sleeve, each locking ramp having an upward and radially outwardly angled ramp surface within said channel adapted to cam a respective inwardly directed tooth outward when the sleeve and adapter are displaced axially toward one another, and a stop surface above said ramp surface for retaining the tooth of the Edison sleeve.

2. The adapter of claim 1, wherein said lower housing has a first plurality of channels of a first length having said locking ramps, and a second plurality of said channels of a second length shorter than said first length for receiving teeth on the Edison sleeve.

3. The adapter of claim 2, wherein said lower housing has four of said first plurality of channels having said locking ramps grouped in two diametrically opposed pairs.

4. The adapter of claim 2, wherein said locking ramps are positioned in said first plurality of channels closer to said lower circular rim than upper ends of said second plurality of channels so that when the teeth on the Edison sleeve cam past said ramp surfaces and are retained by said stops, the teeth in said second plurality of channels abut said upper ends of said second plurality of channels.

5. A fluorescent lamp adapter, comprising:

an upper housing containing circuitry for converting line voltage to the requisite frequency and magnitude for starting and maintaining energization of a fluorescent lamp;

a locking fluorescent lamp plug formed on said upper housing for electrically coupling said adapter to a fluorescent lamp; and a lower housing depending from said upper housing having a locking structure thereon adapted to positively couple to a lower brass sleeve of a standard Edison incandescent light fixture having inwardly directed teeth around an upper peripheral rim, said lower housing including axial channels on an exterior surface thereof adapted to receive said inwardly directed teeth, and wherein said locking structure comprises ramps provided in said channels shaped to cam the teeth on the brass sleeve outward when said adapter and brass sleeve are brought together and retain the teeth thereover to lock the sleeve to said adapter.

6. The lamp adapter of claim 5, wherein said ramps extending radially outward from said channels and are adapted to force the associated teeth of the brass sleeve outward as said adapter is coupled to the sleeve, said ramps each having an upper stop for retaining the sleeve to said adapter.

7. The lamp adapter of claim 5, wherein said lower housing includes at least two said channels on diametrically opposite sides thereof.

8. The lamp adapter of claim 7, wherein said lower housing includes two diametrically opposed pairs of said channels.

9. The lamp adapter of claim 5, wherein said lower housing includes axial channels on an exterior surface thereof adapted to receive said inwardly directed teeth, and wherein said locking structure comprises detents provided in said channels shaped to cam the teeth on the brass sleeve outward when said adapter and brass sleeve are brought together and retain the teeth thereover to lock the sleeve to said adapter.

10. The lamp adapter of claim 5, wherein said lower housing is molded from a material having a low flexibility such that said lower housing can only be compressed inward to release the teeth from said detents with great difficulty.

11. The lamp adapter of claim 10, wherein the material of said lower housing is a UV-stabilized polycarbonate material.

12. A fluorescent lamp adapter for converting a standard incandescent light fixture into a fluorescent light fixture, said adapter including a plug for electrically coupling to a fluorescent lamp, comprising a lower housing adapted to mate with a brass sleeve of a standard Edison incandescent light fixture having a peripheral rim and a plurality of circumferentially spaced, inwardly and downwardly angled teeth, said lower housing being cylindrical and having a plurality of channels formed on an exterior surface, at least two of said channels including locking structure therein for mating with the teeth of the brass sleeve.

13. The lamp adapter of claim 12, wherein said locking structure comprises a ramp surface angled upward and radially outward within said channel adapted to cam the respective tooth outward, and a stop surface above said ramp for retaining the tooth, thus locking the sleeve on said adapter.

* * * * *